US007546753B1

(12) United States Patent
Kim

(10) Patent No.: US 7,546,753 B1
(45) Date of Patent: Jun. 16, 2009

(54) KEY CHAIN ATTACHMENT AND LOCATION APPARATUS AND METHOD

(75) Inventor: Sylvia M. Kim, Old BethPage, NY (US)

(73) Assignee: Charm Zone, Inc., Farmingdale, NY (US)

( * ) Notice: Subject to any disclaimer, the term of this patent is extended or adjusted under 35 U.S.C. 154(b) by 0 days.

(21) Appl. No.: 12/116,414

(22) Filed: May 7, 2008

(51) Int. Cl.
*A44B 15/00* (2006.01)

(52) U.S. Cl. ..... 70/456 R; 24/3.6; 24/3.11; 70/460; 206/37.1; D3/207; D3/208

(58) Field of Classification Search ..... 70/456 R, 70/456 B, 457, 459, 460; D3/207–210; 206/37.1, 206/37.5–37.8, 38.1; 248/685, 915; 24/3, 24/6, 3.1, 3.11, 3.12, 370, 371, 375; 63/1.11, 63/1.12, 12; 150/106
See application file for complete search history.

(56) References Cited

U.S. PATENT DOCUMENTS

| | | | | | |
|---|---|---|---|---|---|
| 173,763 | A * | 2/1876 | Brooks | 70/459 |
| 271,121 | A * | 1/1883 | Riley et al. | 63/12 |
| 490,806 | A * | 1/1893 | Gulick | 40/665 |
| 688,088 | A * | 12/1901 | Bruce | 297/375 |
| 802,140 | A * | 10/1905 | Doane | 63/25 |
| 1,497,346 | A * | 6/1924 | Peterson | 24/3.6 |
| 1,510,822 | A * | 10/1924 | Berndt | 24/3.12 |
| 1,716,358 | A * | 6/1929 | Bloom | 24/600.2 |
| 1,797,098 | A * | 3/1931 | Minehart | 224/268 |
| 2,078,293 | A * | 4/1937 | Smith, Jr. et al. | 70/456 R |
| 2,224,972 | A | 12/1940 | Long, Jr. et al. | 24/3 |
| 2,250,328 | A | 7/1941 | Daniels | 24/3 |
| 2,634,470 | A * | 4/1953 | De Grafft, Jr. | 24/3.13 |
| 2,989,862 | A * | 6/1961 | Segal | 70/459 |
| 3,575,024 | A * | 4/1971 | Schlage | 70/389 |
| 4,543,804 | A * | 10/1985 | Cappiello | 63/12 |
| 4,815,304 | A * | 3/1989 | Kesselman | 70/34 |
| 4,976,124 | A | 12/1990 | Sanders | 70/458 |
| 5,050,414 | A * | 9/1991 | Huang | 70/456 R |
| 5,488,848 | A * | 2/1996 | Huang | 70/456 R |
| D385,415 | S | 10/1997 | Turbide | D3/207 |
| 5,983,686 | A | 11/1999 | Lee | 70/456 |
| 6,301,751 | B1 * | 10/2001 | Ohlson | 24/3.11 |
| 6,334,239 | B1 | 1/2002 | Kraut | 24/3.6 |
| 6,536,081 | B2 | 3/2003 | Allen et al. | 24/3.6 |
| 6,591,646 | B1 | 7/2003 | Huang | 70/456 |
| D539,526 | S | 4/2007 | Stein | D3/207 |
| 7,308,922 | B2 | 12/2007 | Stein | 150/106 |
| 2006/0090302 | A1 * | 5/2006 | Colby | 24/3.6 |
| 2007/0289348 | A1 * | 12/2007 | Wu | 70/456 R |

* cited by examiner

*Primary Examiner*—Lloyd A Gall
(74) *Attorney, Agent, or Firm*—Walter J. Tencza, Jr.

(57) ABSTRACT

An apparatus is provided including a first member, a second member, a device for holding one or more keys, and an ornament. The ornament may be attached to a second end of the first member. The first member may be attached to the second member so that the first member pivots with respect to the second member. The device for holding one or more keys may be attached the second member. The apparatus may further include a spring and a ball, which help to retain the apparatus in a first state in which the first member is at a first angle with respect to the second member. The apparatus can be attached to a purse to easily locate keys.

20 Claims, 11 Drawing Sheets

KEY CHAIN ATTACHMENT AND LOCATION APPARATUS AND METHOD

FIELD OF THE INVENTION

This invention relates to improved methods and apparatus concerning key chain attachment and key chain location devices.

BACKGROUND OF THE INVENTION

There are various devices known in the prior art for attaching keychains. U.S. Pat. No. 7,308,922 and U.S. Design Pat. No. D539,526 to Stein, disclose a key locator. The key locator can be attached to a purse so that an ornament shows outside the purse and the keys are located inside the purse but attached to the key locator.

SUMMARY OF THE INVENTION

One or more embodiments of the present invention provide an apparatus comprising:

a first member having a first end and a second end, and a second member having a first end and a second end. The apparatus may also include a device for holding one or more keys, and an ornament. The ornament may be attached to the second end of the first member. The first end of the first member may be attached to the first end of the second member so that the first member pivots with respect to the second member. The device for holding one or more keys may be attached to the second end of the second member.

The apparatus may further include a spring and a ball. The first member may be hollow and may have a cavity. The spring and the ball may fit within the cavity of the first member. The spring and the ball may help to retain the apparatus in a first state in which the first member is at a first angle with respect to the second member. The first member may include a first portion and a second portion, such that the first member can be separated into the first portion and the second portion in order to remove spring and the ball from the cavity of the first member.

The second member may include a first protrusion, a second protrusion and an indentation between the first protrusion and the second protrusion. The first protrusion, the second protrusion and the indentation are located at the first end of the second member. A substantial portion of the ball may fit within the indentation and thereby retain the apparatus in the first state in which the first member is at the first angle with respect to the second member. The spring and the first member may be elongated, and the spring may fit within the cavity of the first member so that the spring is substantially parallel to the first member.

The spring may press against the ball and the ball may press against a portion of the first end of the second member and thereby retain the apparatus in the first state in which the first member is at the first angle with respect to the second member. The device for holding one or more keys may be comprised of a clasp. The first member and the second member may be elongated.

The apparatus may be clipped onto a purse. The apparatus may also be clipped onto other types of accessories such as a belt. The apparatus may also be clipped onto other items such as an attache, hand bag, and accessories.

One or more embodiments of the present invention may include a method comprising attaching a first end of a first member to a first end of a second member so that the first member pivots with respect to the second member, attaching a device for holding one or more keys to the second end of the second member; and attaching an ornament to the second end of the first member. In one embodiment the second member can be inserted into an interior cavity of a purse while the first member, with the ornament, hangs outside the interior cavity of the purse so that the device for holding one or more keys and the one or more keys can be easily located. The first member can be rotated with respect to the second member until the first member is substantially parallel to the second member to more firmly, temporarily attach the apparatus to the purse.

The method may include attaching one or more keys to the device for holding one or more keys. The method may include rotating the first member with respect to the second member, so that they are no longer substantially parallel and removing the second member and the device for holding one or more keys from the interior cavity of the purse. The method may also include clipping the apparatus previously described onto other items such as an attache, hand bag, belt, and accessories.

DETAILED DESCRIPTION OF THE DRAWINGS

Figure 1:
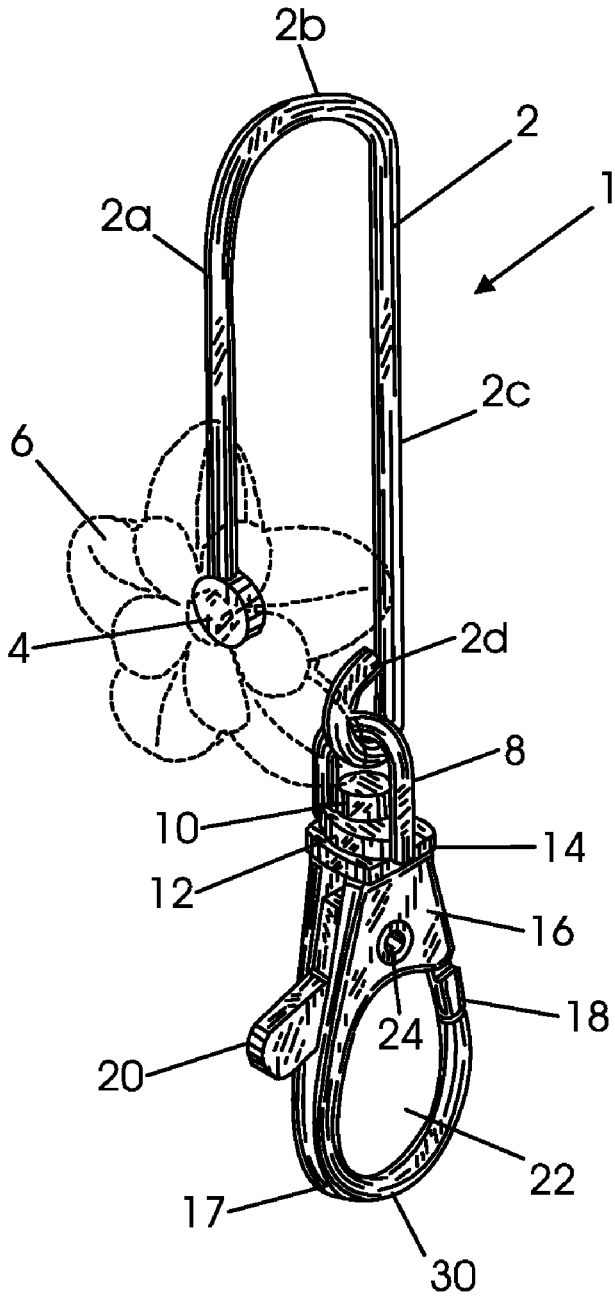
Fig. 1 (Prior Art)
FIG. 1 shows a perspective view of a prior art apparatus.
Figure 2A:
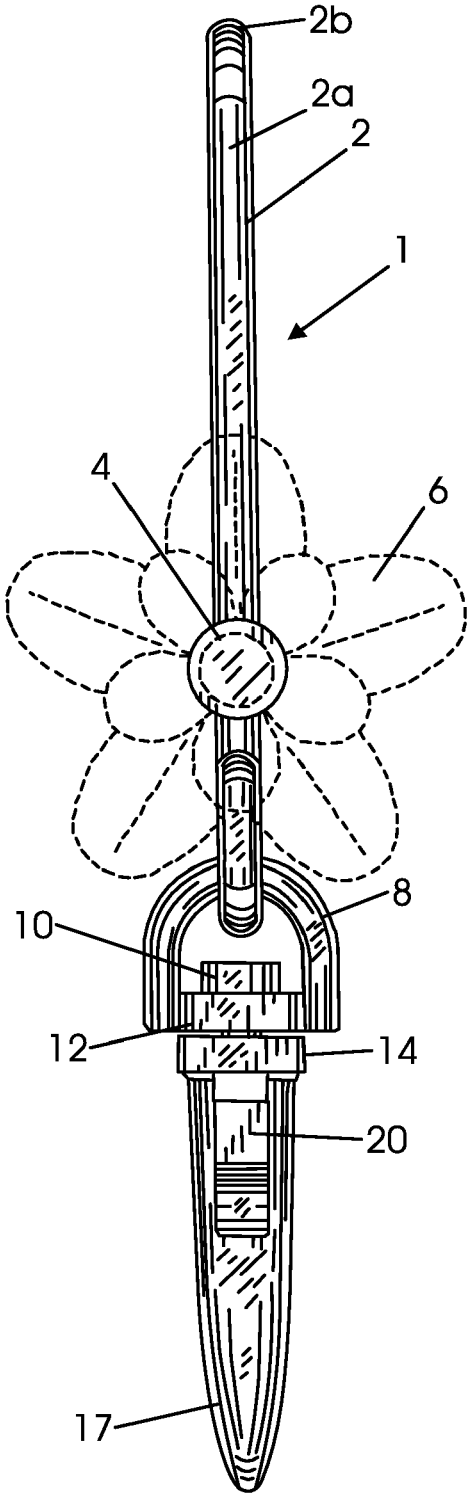
Fig. 2A (Prior Art)
FIG. 2A shows a front view of the prior art apparatus of FIG. 1.
Figure 2B:
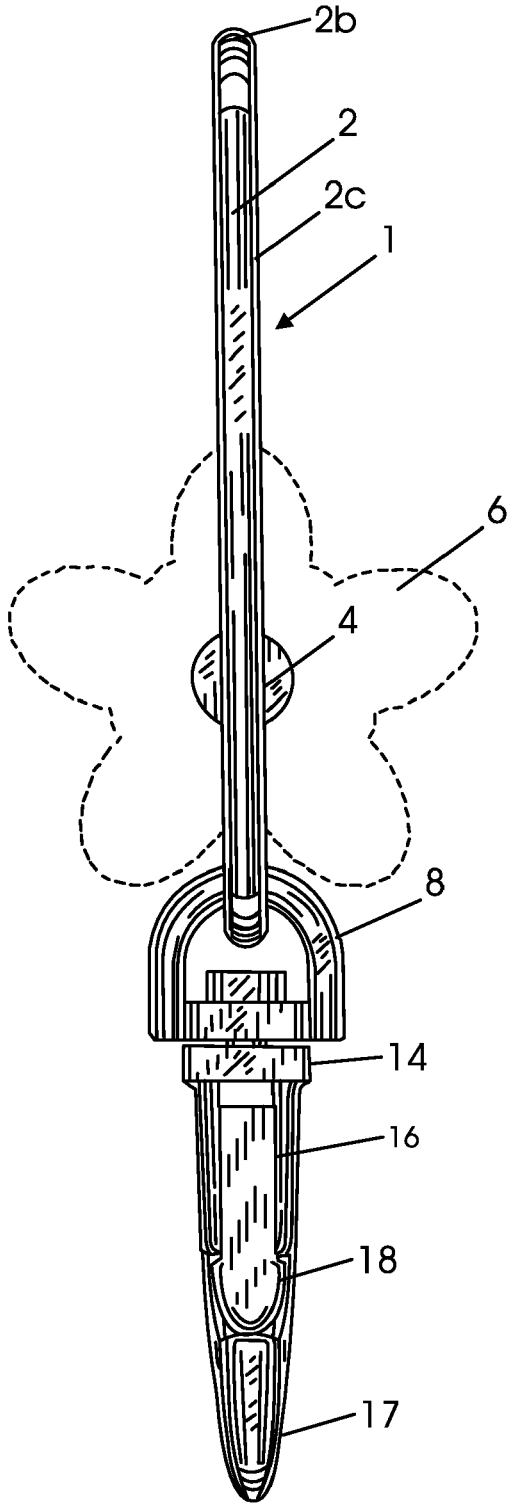
Fig. 2B (Prior Art)
FIG. 2B shows a rear view of the prior art apparatus of FIG. 1.

FIG. 1 shows a perspective view of a prior art apparatus 1. FIGS. 2A, 2B, 3, 4A, and 4B show front, rear, right side, top, and bottom views, respectively, of the apparatus 1 The apparatus 1 may be similar to or identical to the devices shown in U.S. Design Pat. D539,526 to Stein, and U.S. Utility Pat. No. 7,308,922 to Stein, which are incorporated by reference herein.

Figure 3:
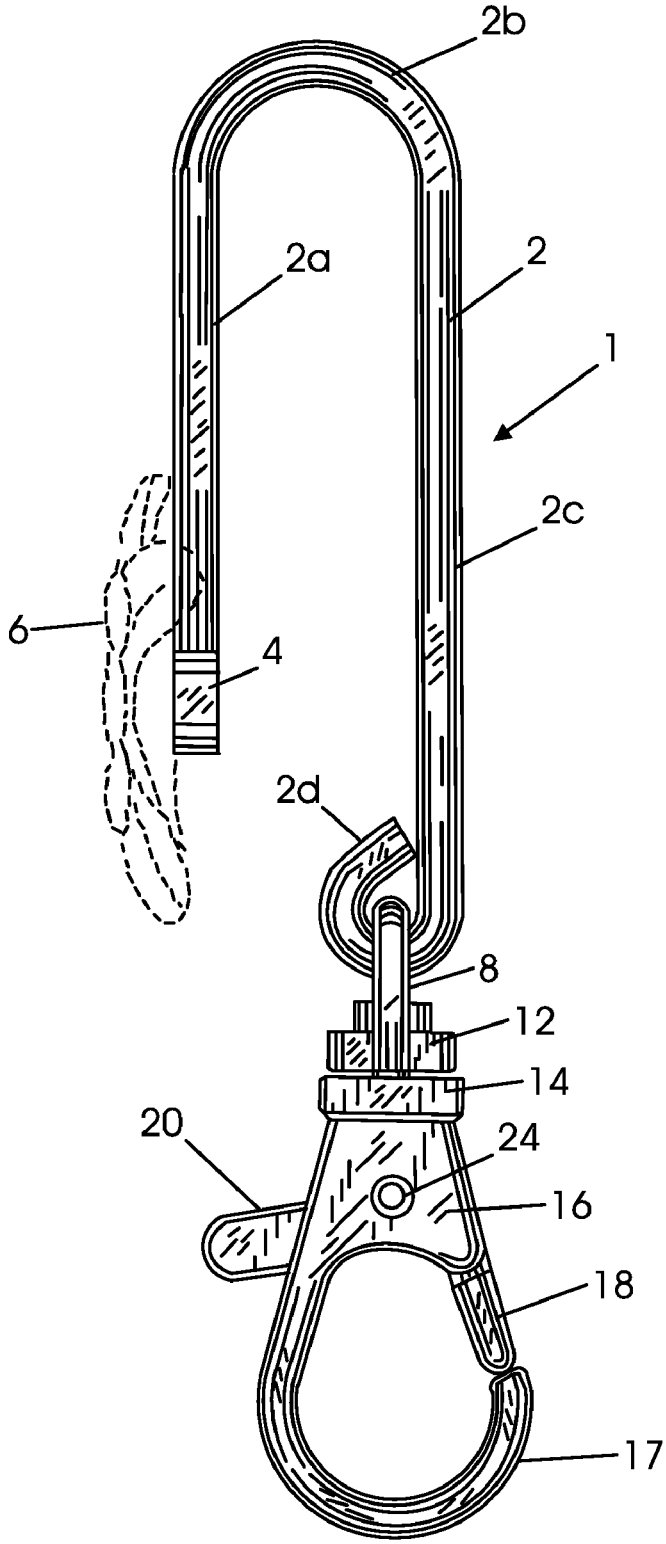
Fig. 3 (Prior Art)
FIG. 3 shows a right side view of the prior art apparatus of FIG. 1.
Figure 4A:
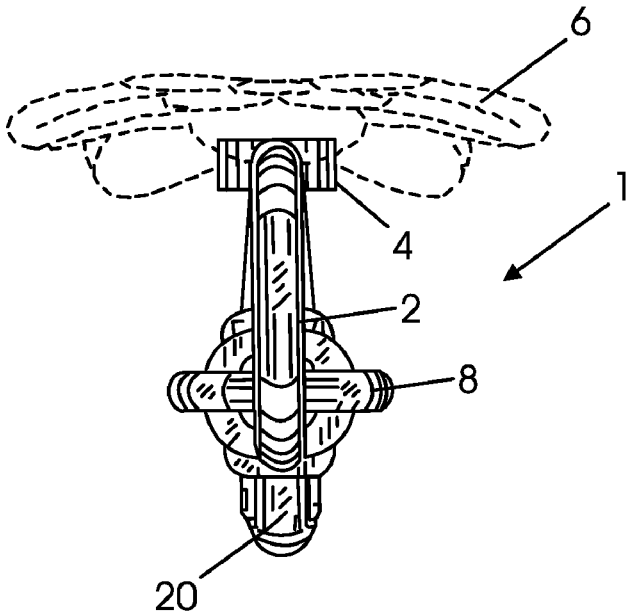
Fig. 4A (Prior Art)
FIG. 4A shows a top view of the prior art apparatus of FIG. 1.
Figure 4B:
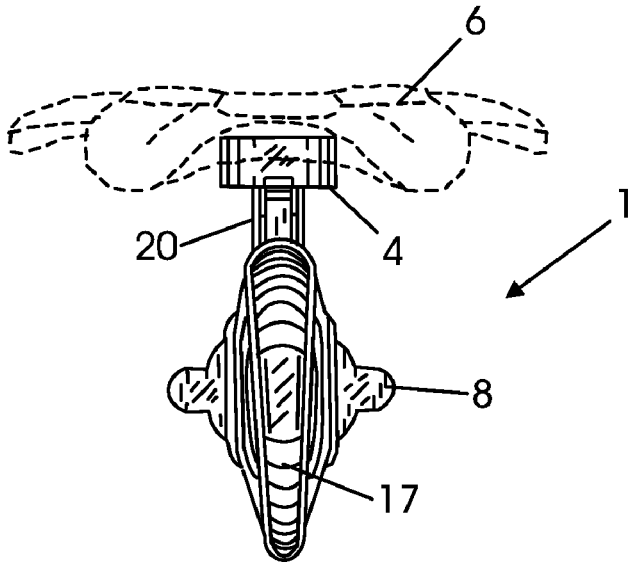
Fig. 4B (Prior Art)
FIG. 4B shows a bottom view of the prior art apparatus of FIG. 1.

The apparatus 1 may include a member 2, an ornament 6, a member 16, and a clasp 30. The member 2 may include a straight portion 2*a*, a curved portion 2*b*, a straight portion 2*c*, and a curved portion 2*d*. The ornament 6 may be connected to the straight portion 2*a* through a member or portion 4. The curved portion or hook portion 2*d* may be hooked onto a u-shaped member 8. The clasp 30 may be controlled by a lever 20 which can open a portion 18. With the portion 18 opened, a curved portion 17 can be inserted through an opening in a key or key chain to thereby hang the key or key chain from the curved portion 17 and from the clasp 30, similar to as shown in FIG. 3 of U.S. Pat. No. 7,308,922, incorporated by reference herein.

The clasp 30 may further include portion or post 10 which allows the clasp 30 to pivot. The clasp 30 may further include portions or members 12, 14, and 16. A pivot pin 24 is provided for allowing the lever 20 to pivot in order to open the portion 18. The clasp 30 has a central opening 22.

Figure 5:
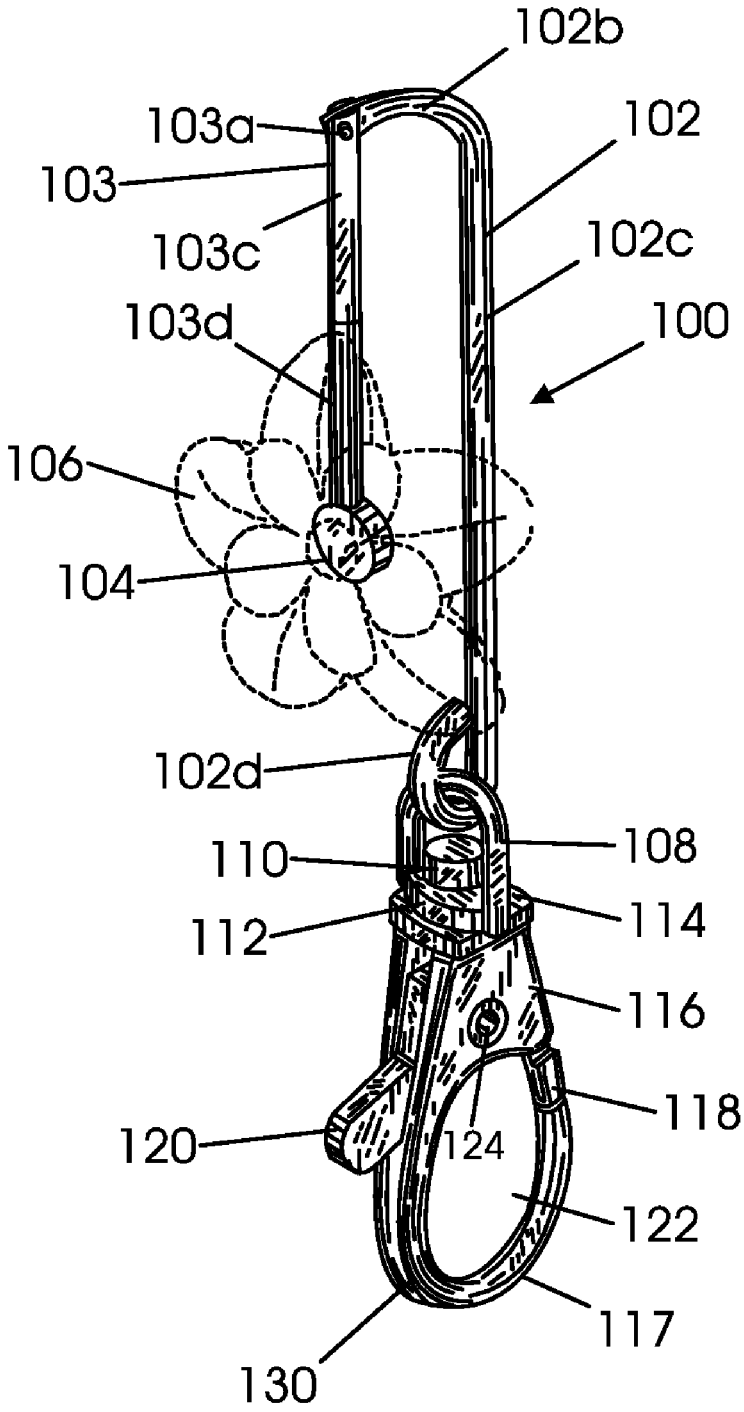
FIG. 5 shows a perspective view of an apparatus in accordance with an embodiment of the present invention.
Figure 6A:
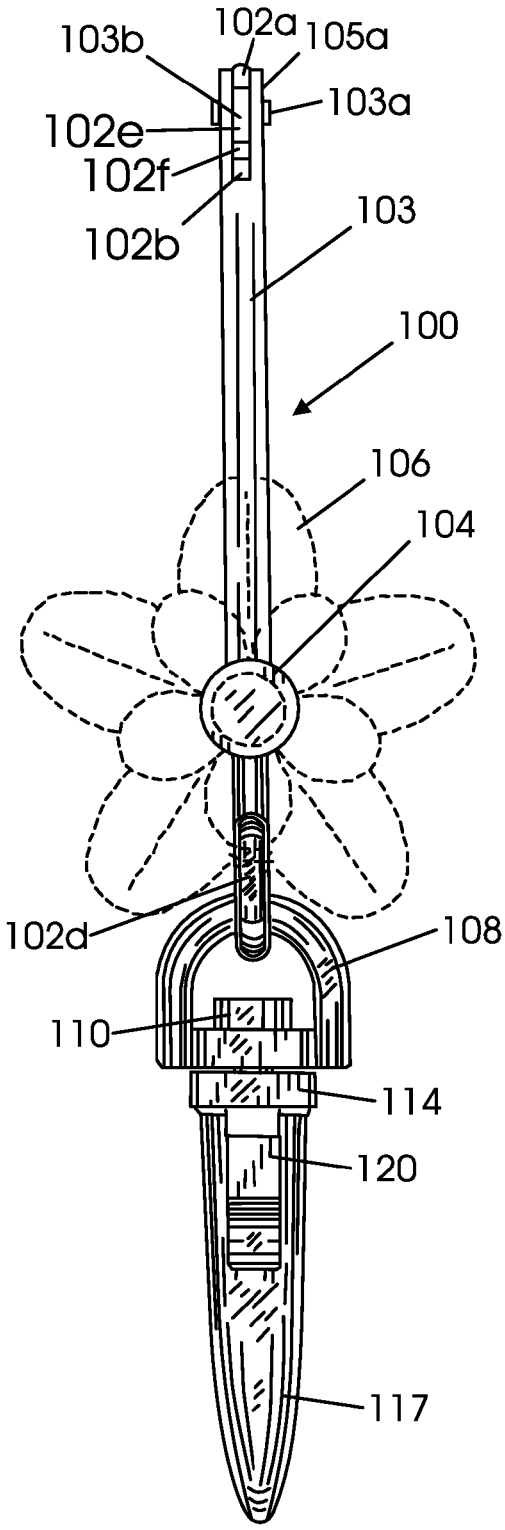
FIG. 6A shows a front view of the apparatus of FIG. 5.
Figure 6B:
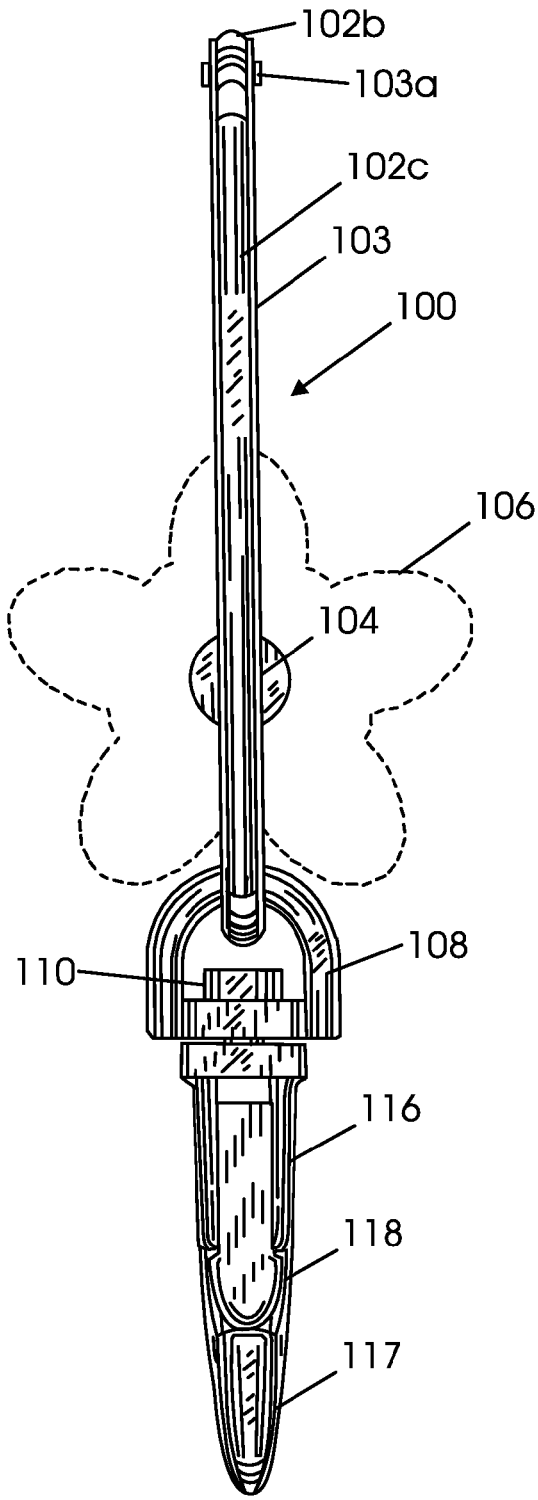
FIG. 6B shows a rear view of the apparatus of FIG. 5.
Figure 7:
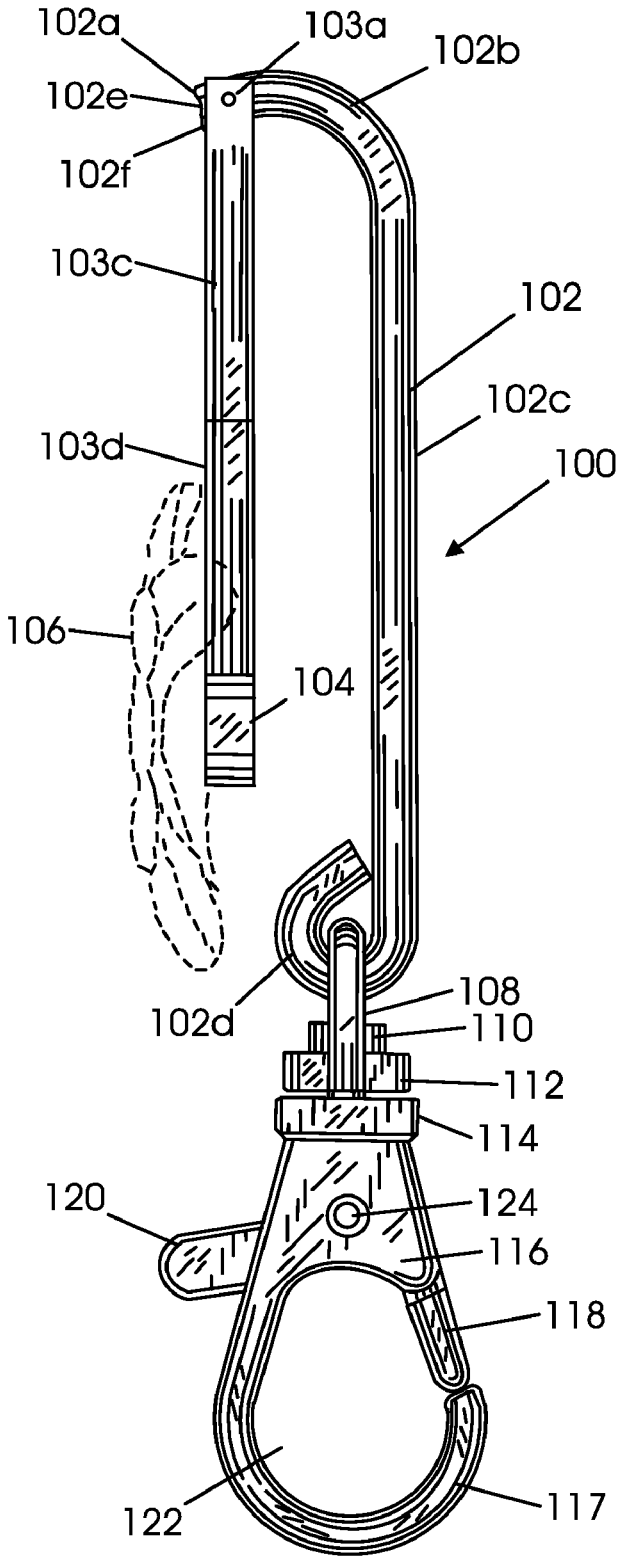
FIG. 7 shows a right side view of the apparatus of FIG. 5.

FIG. 5 shows a perspective view of an apparatus 100 in accordance with an embodiment of the present invention. FIGS. 6A, 6B, and 7 show front, rear, and right side views, respectively, of the apparatus 100 of FIG. 5.

The apparatus 100 may include a member 102, a member 103, an ornament 106, and a clasp 130. The ornament 106 may be attached to the member 103 by a portion or member 104. The member 103 may include portions 103*c* and 103*d*. The member 103 may be attached to a portion 102*b* of the member 102 by a pin 103*a*, in a manner which allows the member 103 to pivot about pivot pin 103*a* with respect to the member 102. The member 102 may include a straight portion 102*c*, the curved portion 102*b*, and the curved or hook portion 102*d*.

The clasp 130 may be similar or identical to the clasp 30 shown in FIG. 1. The clasp 130 may include a u-shaped member 108, and member or post 110. The clasp 130 may further include members 112, 114, and 116, a lever 120, a curved member 117, a portion 118, and a pivot pin 124. The clasp 130 may have an opening 122.

The curved portion or hook portion 102*d* may be hooked onto a u-shaped member 108. The clasp 130 may be controlled by the lever 120 which can open a portion 118. With the portion 118 opened, a curved portion 117 can be inserted through an opening in a key or key chain to thereby hang the key or key chain from the curved portion 117 and from the clasp 130, similar to as shown in FIG. 3 of U.S. Patent No. 7,308,922, incorporated by reference herein.

Figure 8:
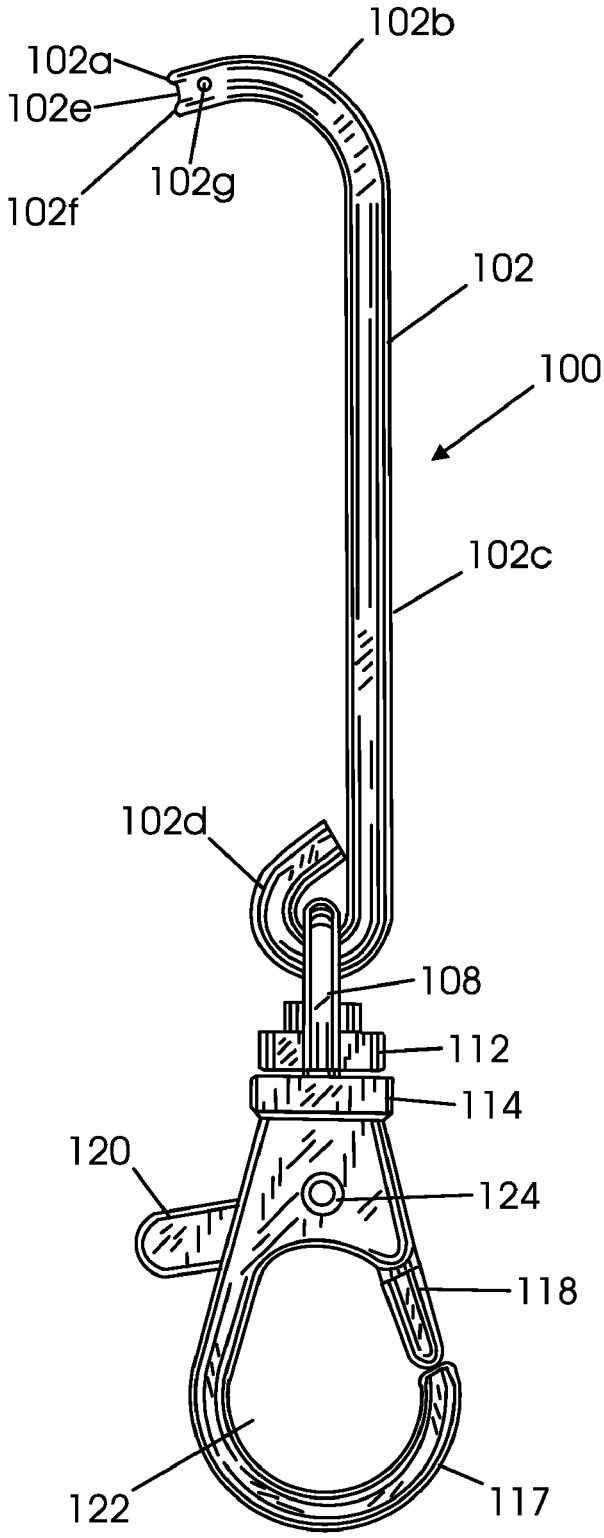
FIG. 8 shows a right side view of a portion of the apparatus of FIG. 5.
Figure 9:
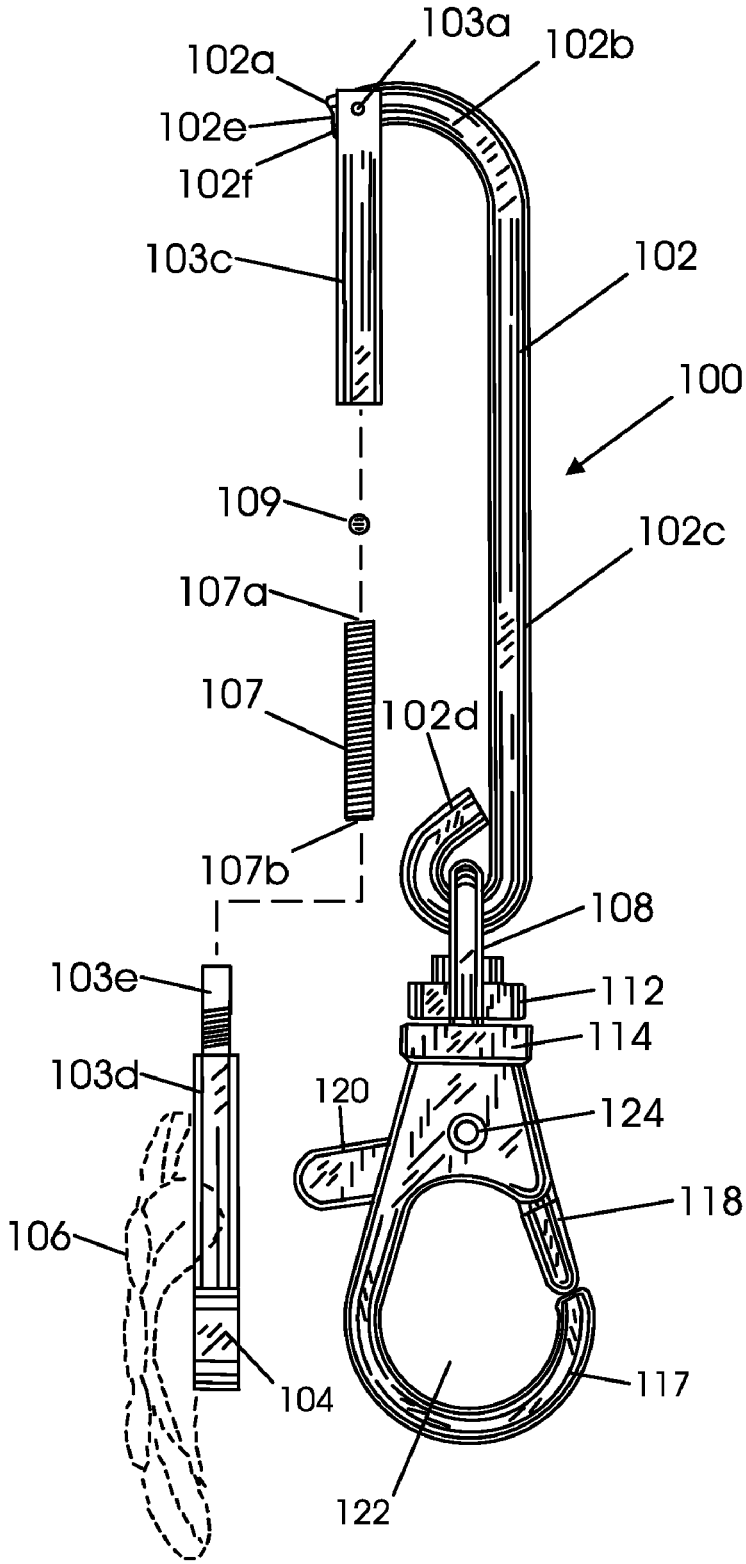
FIG. 9 shows a right side view of the apparatus of FIG. 5, with the apparatus of FIG. 5 taken apart.

FIG. 8 shows a right side view of a portion of the apparatus 100 of FIG. 5. FIG. 8 shows protruding ends 102*a* and 102*f* of the member 102 and a central indented portion 102*e*. The portion 102*b* has an opening 102*g* into which the pivot pin 103*a* can be inserted to attaching the member 103 shown in FIG. 7 so that it can pivot, in a limited manner with respect to the member 102. FIG. 9 shows a right side view of the apparatus 100, with the apparatus 100 taken apart. As shown by FIG. 9, the member 103 includes portion 103*c* which is connected to the member 102 by pivot pin 103*a* and portion 103*d* which is connected to the ornament 106 by portion 104. The portion 103*c* may be a hollow tube having interior threads inside a cavity. The portion 103*d* has an extension 103*e* which may have exterior threads which can be inserted into and screwed into interior threads within the interior cavity of the portion 103*c*.

FIG. 9 also shows a spring 107 and a ball 109, such as a steel ball. To assemble the apparatus 100, the ball 109 is inserted into the cavity of the portion 103*c*, and thereafter the spring 107 is inserted into the cavity of the portion 103*c* so that the ball 109 rests on the top 107*a* of the spring 107 The extension 103*e* is then inserted into the cavity of the portion 103*c* so that the extension 103*e* pushes against the end 107*b* of the spring 107. The member 103*d* can be pushed upwards or turned so that the extension 103*e* is attached within the cavity of the portion 103*c*. The ball 109 is pushed upwards until the ball 109 contacts or is in close proximity to a portion 102*h* of the member 102, as shown in FIG. 11.

Figure 10:
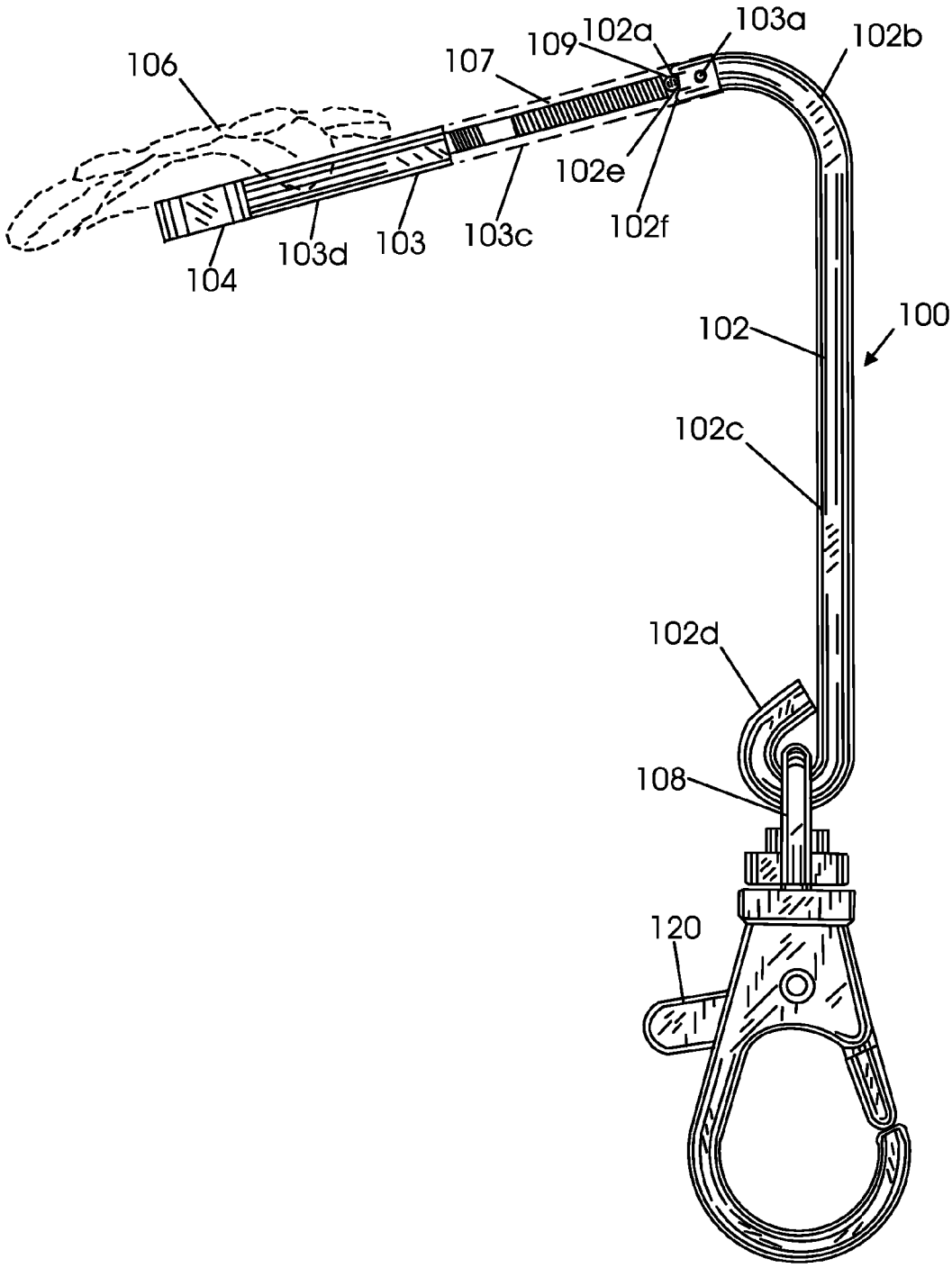
FIG. 10 shows a right side view of the apparatus of FIG. 5, with the apparatus of FIG. 5 in a first state.

FIG. 10 shows a right side view of the apparatus 100, with the apparatus 100 in a first state, and with the portion 103*c* shown by dashed lines so that the interior of the portion 103*c* can be seen. In FIG. 10 the portion 103*d* has been fully attached to the portion 103*c*. The extension 103*e* pushes on the spring 107 which pushes on the ball 109. The ball 109 is located in the gap or indentation 102*e*, between the protrusions 102*a* and 102*f*. The location of the ball 109 in the gap or indentation 102*e* maintains the portions 103*c* and 103*d* and member 103, and thereby the ornament 106 in the state and position shown in FIG. 10, assuming no external force (other than gravity) acts on the member 103. This configuration, allows the apparatus 100 to be detached from an item, such as a purse, without the member 103 automatically rotating back into the state shown in FIG. 7.

Figure 11:
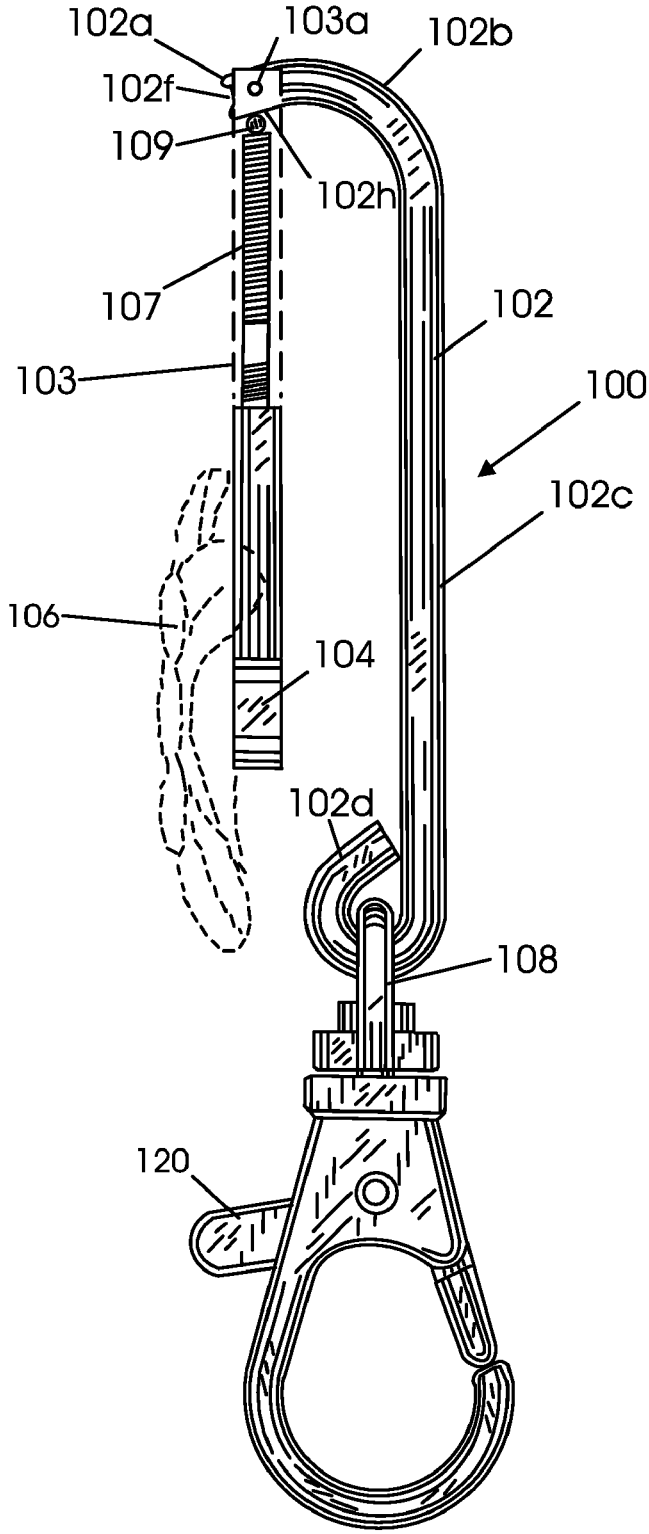
FIG. 11 shows a right side view of the apparatus of FIG. 5, with the apparatus of FIG. 5 in a second state.

FIG. 11 shows a right side view of the apparatus 100 of FIG. 5, with the apparatus 100 of FIG. 5 in a second state. An external force (other than gravity), such as a person using their hand to push the member 103 to rotate back towards the member 102, has been applied to change from the state of FIG. 10 to the state of FIG. 11. FIG. 11 also shows the portion 103*c* in dashed lines to allow the spring 107 and ball 109 to be seen. The ball 109 rests under portion 102*b* of the member 102. The member 103 can be rotated away from the portion 102*c* of the member 102 and back into the configuration of FIG. 10, in which the ball 109 is in the indentation 102*e*.

In operation, the member 102 can be inserted into an interior cavity of a purse (not shown), so that the device for holding one or more keys (such as including clasp 130) is located in the interior cavity of the purse, and so that the first member 103 and the ornament 106 lie outside the interior cavity of the purse. The member 102 and the clasp 130 can be inserted into the interior cavity of the purse when the apparatus 100 is in the state shown in FIG. 10. Thereafter, the member 103 can be rotated towards the portion 102*c* of the member 102 until the member 103 is substantially parallel with the portion 102*c* of the member 102, as shown in FIG. 11. An edge of the purse would then lie between the member 103 and the member 102, and the members 102 and 103 would tightly press against the edge of the purse or a portion of the purse in order to securely hold the apparatus 100 to the edge of the purse. The spring 107 and ball 109 retain the apparatus 100 in the state of FIG. 11 in which the members 103 and 102 press against the edge or portion of the purse. Pressure is needed to rotate the member 103 from the state in FIG. 11 to the state in FIG. 10 or vice versa.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first member having a first end and a second end;

a second member having a first end and a second end;

a device for holding one or more keys;

an ornament;

wherein the ornament is attached to the second end of the first member;

wherein the first end of the first member is attached to the first end of the second member so that the first member pivots with respect to the second member;

wherein the device for holding one or more keys is attached to the second end of the second member;

wherein the first member is substantially rigid so that the first member retains its shape when the first member is pivoted from a first orientation in which the first member is parallel to a substantial portion of the second member to a second orientation in which the first member is at a substantial angle with respect to the substantial portion of the second member;

wherein the first member includes a first portion and a second portion, which are attached together to form the first member;

wherein the first member is configured to be separated into the first portion and the second portion;

wherein each of the first portion and the second portion is an elongated substantially rigid member, wherein when the first portion and the second portion are attached to each other, each of the first portion and the second portion retains its shape when the first member is pivoted from the first orientation in which the first member is parallel to the substantial portion of the second member to the second orientation in which the first member is at a substantial angle with respect to the substantial portion of the second member;

wherein the first portion includes the first end of the first member and is attached to the first end of the second member so that the first member pivots with respect to the second member; and wherein the second portion includes the second end of the first member which is attached to the ornament.

2. The apparatus of claim 1 wherein the device for holding one or more keys is comprised of a clasp.

3. The apparatus of claim 1 further comprising a spring;

a ball;

wherein the first portion of the first member is hollow and has a cavity;

wherein the spring and the ball fit within the cavity of the first portion;

and wherein the spring and the ball help to retain the apparatus in a first state in which the first portion is at a first angle with respect to the substantial portion of the second member.

4. An apparatus comprising:

a first member having a first end and a second end;

a second member having a first end and a second end;

a device for holding one or more keys;

an ornament;

wherein the ornament is attached to the second end of the first member;

wherein the first end of the first member is attached to the first end of the second member so that the first member pivots with respect to the second member;

wherein the device for holding one or more keys is attached to the second end of the second member;

and further comprising a spring;

a ball;

wherein the first member is hollow and has a cavity;

the cavity extending along a lengthwise direction of the first member between its first and second end;

wherein the spring and the ball fit within the cavity of the first member;

and wherein the spring and the ball help to retain the apparatus in a first state in which the first member is at a first angle with respect to the second member.

5. The apparatus of claim 4 wherein the first member includes a first portion and a second portion;

wherein the first member can be separated into the first portion and the second portion in order to remove spring and the ball from the cavity of the first member.

6. The apparatus of claim 4 wherein the second member includes a first protrusion, a second protrusion and an indentation between the first protrusion and the second protrusion;

wherein the first protrusion, the second protrusion and the indentation are located at the first end of the second member;

and wherein a substantial portion of the ball fits within the indentation and thereby retains the apparatus in the first state in which the first member is at the first angle with respect to the second member.

7. The apparatus of claim 4 wherein the spring and the first member are elongated, and the spring fits within the cavity of the first member so that the spring is substantially parallel to the first member.

8. The apparatus of claim 4 wherein the spring presses against the ball and the ball presses against a portion of the first end of the second member and thereby retains the apparatus in the first state in which the first member is at the first angle with respect to the second member.

9. A method comprising:

attaching a first end of a first member to a first end of a second member so that the first member pivots with respect to the second member;

attaching a device for holding one or more keys to the second end of the second member; and attaching an ornament to the second end of the first member; and wherein the first member is substantially rigid so that the first member retains it shape when the first member is pivoted from a first orientation in which the first member is parallel to a substantial portion of the second member to a second orientation in which the first member is at a substantial angle with respect to the substantial portion of the second member;

wherein the first member includes a first portion and a second portion, which are attached together to form the first member; and further comprising configuring the first member to be separated into the first portion and the second portion;

wherein each of the first portion and the second portion is an elongated substantially rigid member, wherein when the first portion and the second portion are attached to each other, each of the first portion and the second portion retains its shape when the first member is pivoted from the first orientation in which the first member is parallel to the substantial portion of the second member to the second orientation in which the first member is at a substantial angle with respect to the substantial portion of the second member;

wherein the first portion includes the first end of the first member and is attached to the first end of the second member so that the first member pivots with respect to the second member; and wherein the second portion includes the second end of the first member which is attached to the ornament.

10. The method of claim 9 wherein the device for holding one or more keys is comprised of a clasp.

11. The method of claim 9 wherein the first portion of the first member is hollow and has a cavity;

and further comprising separating the first member into the first portion and the second portion;

placing a spring and a ball within the cavity of the first portion of the first member;

and connecting the first portion and the second portion with the spring and the ball in the cavity of the first portion;

and wherein with the spring and the ball placed in the cavity of the first portion and with the first portion connected to the second portion, the spring and the ball help to retain the first member in the second orientation in which the first member is at a substantial angle with respect to the substantial portion of the second member.

12. The method of claim 9 further comprising attaching one or more keys to the device for holding one or more keys.

13. The method of claim 9 further comprising inserting the second member into an interior cavity of a purse, so that the device for holding one or more keys is located in the interior cavity of the purse, and so that the first member and the ornament lie outside the interior cavity of the purse.

14. The method of claim 12 further comprising inserting the second member into an interior cavity of a purse, so that the device for holding one or more keys is located in the interior cavity of the purse, and so that the first member and the ornament lie outside the interior cavity of the purse.

15. The method of claim 14 further comprising rotating the first member with respect to the second member;

and removing the second member and the device for holding one or more keys from the interior cavity of the purse.

16. A method comprising:

attaching a first end of a first member to a first end of a second member so that the first member pivots with respect to the second member;

attaching a device for holding one or more keys to the second end of the second member; and attaching an ornament to the second end of the first member;

fitting a spring and a ball within a cavity of the first member;

the cavity extending along a lengthwise direction of the first member between its first and second end;

and wherein the spring and the ball help to retain the first member at a first angle with respect to the second member.

17. The method of claim 16 wherein the first member includes a first portion and a second portion;

wherein the first member can be separated into the first portion and the second portion in order to remove the spring and the ball from the cavity of the first member.

18. The method of claim 16 wherein the second member includes a first protrusion, a second protrusion and an indentation between the first protrusion and the second protrusion;

wherein the first protrusion, the second protrusion and the indentation are located at the first end of the second member;

and wherein a substantial portion of the ball fits within the indentation and thereby retains the first member at the first angle with respect to the second member.

19. The method of claim 16 wherein the spring and the first member are elongated, and the spring fits within the cavity of the first member so that the spring is substantially parallel to the first member.

20. The method of claim 16 wherein the spring presses against the ball and the ball presses against a portion of the first end of the second member and thereby retains the first member at the first angle with respect to the second member.

* * * * *